US008644753B2

(12) United States Patent
Ohmori et al.

(10) Patent No.: US 8,644,753 B2
(45) Date of Patent: Feb. 4, 2014

(54) CLEANING BLADE, AND IMAGE FORMING APPARATUS AND PROCESS CARTRIDGE USING SAME

(75) Inventors: Masahiro Ohmori, Kanagawa (JP); Yohta Sakon, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 331 days.

(21) Appl. No.: 13/215,305

(22) Filed: Aug. 23, 2011

(65) Prior Publication Data

US 2012/0063826 A1 Mar. 15, 2012

(30) Foreign Application Priority Data

Sep. 13, 2010 (JP) ..... 2010-204704

(51) Int. Cl.
*G03G 21/10* (2006.01)

(52) U.S. Cl.
USPC ..... 399/350; 399/351; 15/93.1

(58) Field of Classification Search
USPC ..... 399/351
See application file for complete search history.

(56) References Cited

U.S. PATENT DOCUMENTS

| | | | | |
|---|---|---|---|---|
| 7,817,956 | B2 * | 10/2010 | Sugimoto | 399/350 |
| 2003/0233722 | A1 * | 12/2003 | Sawamura et al. | 15/245 |
| 2009/0311017 | A1 | 12/2009 | Ohmori et al. | |

FOREIGN PATENT DOCUMENTS

| | | | | |
|---|---|---|---|---|
| JP | 04309534 | A * | 11/1992 | C08J 7/04 |
| JP | 2001151085 | A * | 6/2001 | B60S 1/38 |
| JP | 2004-233818 | | 8/2004 | |
| JP | 3602898 | | 10/2004 | |
| JP | 2009-223073 | | 10/2009 | |
| JP | 2010-152295 | | 7/2010 | |
| JP | 2010-281974 | | 12/2010 | |

* cited by examiner

*Primary Examiner* — Clayton E LaBalle
*Assistant Examiner* — Leon W Rhoades, Jr.
(74) *Attorney, Agent, or Firm* — Cooper & Dunham LLP

(57) ABSTRACT

A cleaning blade for cleaning a moving surface of an object by contacting an edge thereof with the moving surface is provided. The cleaning blade includes a strip-shaped elastic main body, in which a leading end portion thereof including the edge is impregnated with an ultraviolet-crosslinked resin; and a cover layer, which is located on a surface of a portion of the crosslinked resin-impregnated portion including the edge as an outermost layer and which has higher hardness than the strip-shaped elastic main body.

14 Claims, 6 Drawing Sheets

PROJECTED IMAGE OF PARTICLE PERIPHERAL LENGTH: C1

AREA: S

CIRCLE WITH AREA OF S PERIPHERAL LENGTH: C2

AREA: S

CLEANING BLADE, AND IMAGE FORMING APPARATUS AND PROCESS CARTRIDGE USING SAME

CROSS-REFERENCE TO RELATED APPLICATIONS

This patent application is based on and claims priority pursuant to 35 U.S.C. §119 to Japanese Patent Application No. 2010-204704, filed on Sep. 13, 2010, in the Japan Patent Office, the entire disclosure of which is hereby incorporated herein by reference.

FIELD OF THE INVENTION

This disclosure relates to a cleaning blade, and to an image forming apparatus and a process cartridge using the cleaning blade.

BACKGROUND OF THE INVENTION

In electrophotographic image forming apparatuses, residual toner remaining on the surface of an image bearing member even after a toner image thereon is transferred onto a recording material or an intermediate transfer medium is removed therefrom using a cleaning device.

Strip-shaped cleaning blades made of an elastic material such as polyurethane rubbers are typically used for such a cleaning device because of having advantages such that the cleaning device has simplified structure and good cleanability. Among such cleaning blades, a cleaning blade in which one end thereof is supported by a supporter, and an edge of the other end is contacted with a surface of an image bearing member to block and scrape off residual toner on the image bearing member, thereby removing the residual toner from the surface of the image bearing member.

In attempting to meet a recent need of forming high quality images, there are image forming apparatuses using spherical toner (hereinafter referred to as polymerization toner), which has a relatively small particle diameter and which is prepared by a method such as polymerization methods. Since such polymerization toner has such an advantage as to have a higher transfer efficiency than pulverization toner, which has been conventionally used, the polymerization toner can meet the need. However, polymerization toner has such a drawback as not to be easily removed from an image bearing member by a cleaning blade. This is because such polymerization toner has a spherical form and a small particle diameter, and easily passes through a small gap between the tip of a cleaning blade and the surface of an image bearing member.

In attempting to prevent polymerization toner from passing through a gap between a cleaning blade and an image bearing member, it is necessary to increase the pressure to the cleaning blade contacted with the surface of the image bearing member to enhance the cleanability of the cleaning blade. However, when the contact pressure of the cleaning blade is increased, the friction between the cleaning blade and the image bearing member is increased, and thereby the tip of the cleaning blade is pulled by the image bearing member in the moving direction of the image bearing member. Specifically, as illustrated in FIG. 8(*a*), a cleaning blade 62 is pulled by the surface of an image bearing member 123 in a moving direction (indicated by an arrow) of the image bearing member due to increase of friction between the blade and the image bearing member, thereby causing a problem (hereinafter referred to as everted-tip problem) in that an edge 62*c* of a tip 62*a* of the blade 62 is everted. In this regard, the thus everted tip has a restoring force, and therefore the tip tends to vibrate, resulting in generation of fluttering sounds.

In addition, when the cleaning operation is continued while the edge 62*c* of the cleaning blade 62 is everted, a portion of the tip 62*a* of the cleaning blade 62, which is apart from the edge 62*c* by few micrometers, is abraded as illustrated in FIG. 8(*b*). When the cleaning blade 62 is further used for the cleaning operation, the portion of the tip 62*a* of the blade 62 is further abraded, resulting in lack of the edge 62*c* of the blade 62 as illustrated in FIG. 8(*c*). The cleaning blade 62 having no edge cannot remove residual toner from the surface of the image bearing member 123, thereby forming an abnormal image in which background thereof is soiled with residual toner.

In attempting to prevent occurrence of the problem, there is a proposal in which a cover layer made of a resin, which is harder than a rubber and has a pencil hardness of from B to 6H, is formed at least on the edge of the tip of a cleaning blade made of a polyurethane elastomer. It is described therein that by forming such a cover layer, friction between the tip of the cleaning blade and a surface of an image bearing member can be reduced while enhancing the abrasion resistance of the cleaning blade. In addition, it is described therein that since the cover layer is hard and is not easily deformed, occurrence of the everted-tip problem can be prevented.

Further, in attempting to prevent occurrence of the everted-tip problem, there is another proposal in which a blade impregnated with an ultraviolet crosslinkable material including a silicone so as to be swelled is exposed to ultraviolet rays so that the surface of the blade is covered with the crosslinked material, which is harder than rubbers and has good abrasion resistance. It is described therein that by covering the surface of the cleaning blade with an ultraviolet crosslinked material having higher hardness than the elastic blade, the abrasion resistance of the cleaning blade can be enhanced. In addition, it is described therein that since the surface portion of the blade is made of a combination of a rubber and a crosslinked material and has higher hardness than a rubber, the hard portion of the blade can be normally contacted with an image bearing member even when the blade is used over a long period of time and the cover layer of the blade is abraded, resulting in prevention of serious abrasion of the blade and generation of fluttering sounds.

However, even when the above-mentioned cleaning blades are used, occurrence of the above-mentioned problems is hardly prevented if images having a high image area proportion (such as image having large solid images) are continuously produced (i.e., if the amount of residual toner on an image bearing member to be removed by the cleaning blade is large). The reason is considered to be as follows.

Specifically, since the blade has a cover layer on the tip thereof or includes a crosslinked material in a surface portion thereof in the longitudinal direction thereof, the elastic property of the rubber of the blade tends to deteriorate. When the elastic property of the blade is deteriorated, the blade cannot be satisfactorily contacted with the surface of an image bearing member (i.e., the pressure of the blade to an image bearing member varies) if the image bearing member is eccentric or the surface thereof is waved. In addition, when images having high image area proportions are continuously produced and a large amount of residual toner is present on the surface of the image bearing member, the large amount of toner is collected at the tip of the blade by being blocked by the blade. In this case, the residual toner at the tip of the blade tends to pass through a relatively large gap formed between a portion of the blade and the surface of the image bearing member, which are contacted with each other at a relatively low pressure due to eccentricity of the image bearing member or waving of the surface thereof, resulting in occurrence of the above-mentioned abnormal image problem.

In the first mentioned cleaning blade, when a thick cover layer made of a material having high hardness is formed, the elastic property of the rubber constituting the blade is deteriorated by the rigid cover layer, and thereby the blade cannot be satisfactorily contacted with the surface of an image bearing member (i.e., the pressure of the blade to an image bearing member varies). Therefore, the cover layer is preferably as thin as possible. However, when a thin cover layer is formed, the cover layer is easily worn out and the rubber is exposed after a short period of time, resulting in occurrence of the above-mentioned everted-tip problems.

In addition, the second-mentioned cleaning blade has the following drawback. Specifically, in order to impart the same hardness as that of the cover layer of the first mentioned cleaning blade to the surface of the crosslinked material-impregnated cleaning blade, it is necessary that the blade is impregnated with a large amount of ultraviolet crosslinkable material to such an extent that the surface of the blade is covered with the crosslinkable material. In this case, the ultraviolet crosslinkable material penetrates into an inner portion of the blade. When ultraviolet rays irradiate the blade to crosslink the ultraviolet crosslinkable material, the material-impregnated portion of the blade, which has a considerable thickness, becomes too hard, thereby deteriorating the elasticity of the rubber (blade), resulting in occurrence of the above-mentioned abnormal problem. In contrast, when the blade is impregnated with a small amount of ultraviolet crosslinkable material to maintain the elasticity of the blade, the rubber of the blade is not perfectly covered with the crosslinked material (i.e., the surface portion is constituted of a combination of the rubber and the crosslinked material), and therefore the surface portion has lower hardness than the cover layer of the first-mentioned blade. In addition, friction between the surface of the blade and a surface of an image bearing member cannot be satisfactorily decreased, thereby causing the above-mentioned everted-tip problem.

Because of these reasons, the inventors recognized that there is a need for a cleaning blade which has good abrasion resistance and which can be satisfactorily contacted with a surface of an image bearing member at substantially a constant pressure to satisfactorily perform a cleaning operation without causing the fluttering sound problem and the everted-tip problem.

BRIEF SUMMARY OF THE INVENTION

As an aspect of this disclosure, a cleaning blade is provided which includes a strip-shaped elastic main body, in which a surface portion of a tip thereof including an edge to be contacted with a moving surface of an object to be cleaned is impregnated with an ultraviolet-crosslinked resin; and a cover layer, which is located on a surface of a portion of the resin-impregnated tip including the edge as an outermost layer and which has higher hardness than the strip-shaped elastic main body.

As another aspect of this disclosure, an image forming apparatus is provided which includes an image bearing member to bear a visible image on a surface thereof while moving; a transferring device to transfer the visible image on the image bearing member to a recording material; and a cleaner to clean the surface of the image bearing member with the above-mentioned cleaning blade after the visible image is transferred.

As yet another aspect of this disclosure, a process cartridge is provided which includes at least an image bearing member to bear a visible image thereon while moving; and a cleaner to clean the surface of the image bearing member with the above-mentioned cleaning blade after the visible image is transferred to a recording material, wherein the image bearing member and the cleaner are integrated into a single unit so as to be detachably attachable to an image forming apparatus.

The aforementioned and other aspects, features and advantages will become apparent upon consideration of the following description of the preferred embodiments taken in conjunction with the accompanying drawings.

DETAILED DESCRIPTION OF THE INVENTION

Initially, an example of the image forming apparatus of this disclosure will be described by reference to drawings.

Figure 2:
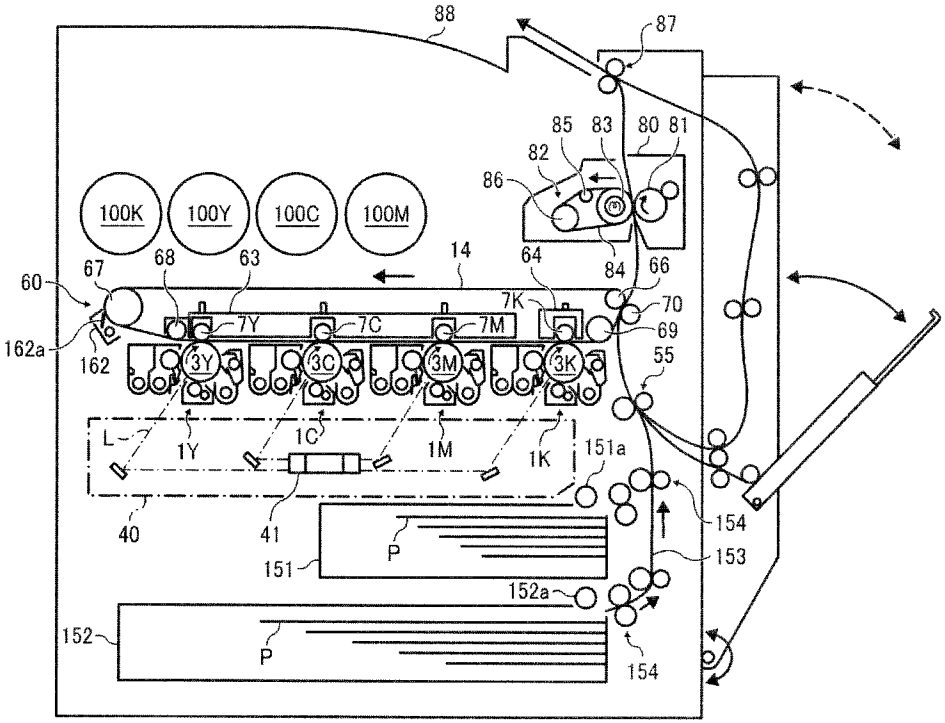
FIG. 2 is a schematic cross-sectional view illustrating an example of the image forming apparatus of this disclosure.

FIG. 2 illustrates an electrophotographic printer as an example of the image forming apparatus of this disclosure.

Referring to FIG. 2, a printer 500 includes four image forming units, i.e., yellow (Y), cyan (C), magenta (M) and black (K) image forming units 1Y, 1C, 1M and 1K. The four image forming units 1Y, 1C, 1M and 1K have the same configuration except that the color of toner used for developing an electrostatic latent image on an image bearing member is different.

The printer 500 further includes a transfer unit 60, which includes an intermediate transfer belt 14 and which is located above the four image forming units 1. As mentioned later in detail, Y, C, M and K toner images formed on respective photoreceptors 3Y, 3C, 3M and 3K serving as image bearing members are transferred onto the surface of the intermediate transfer belt 14 so as to be overlaid, resulting in formation of a combined color toner image on the intermediate transfer belt 14.

In addition, an optical writing unit 40 serving as a latent image forming device is located below the four image forming units 1. The optical writing unit 40 emits light beams L (such as laser beams) based on Y, C, M and K image information to irradiate the photoreceptors 3Y, 3C, 3M and 3K with the laser beams L, thereby forming electrostatic latent images, which respectively correspond to the Y, C, M and K images to be formed, on the photoreceptors. The optical writing unit 40 includes a polygon mirror 41, which is rotated by a motor and which reflects the light beams L emitted by a light source of the optical writing unit while deflecting the laser beams to irradiate the photoreceptors 3Y, 3C, 3M and 3K with the laser beams L via optical lenses and mirrors. The optical writing unit 40 is not limited thereto, and an optical writing unit using a LED array or the like can also be used therefor.

Below the optical writing unit 40, a first sheet cassette 151, and a second sheet cassette 152 are arranged so that the first sheet cassette is located above the second sheet cassette. Each of the sheet cassettes 151 and 152 contains a stack of paper sheets P serving as a recording material. Uppermost sheets of the paper sheets P in the first and second sheet cassettes 151 and 152 are contacted with a first feed roller 151*a* and a second feed roller 152*a*, respectively. When the first feed roller 151*a* is rotated (counterclockwise in FIG. 2) by a driving device (not shown), the uppermost sheet P in the first sheet cassette 151 is fed by the first feed roller 151*a* toward a sheet passage 153 located on the right side of the printer 500 while extending vertically. Similarly, when the second feed roller 152*a* is rotated (counterclockwise in FIG. 2) by a driving device (not shown), the uppermost sheet P in the second sheet cassette 152 is fed by the second feed roller 152*a* toward the sheet passage 153.

Plural pairs of feed rollers 154 are arranged in the sheet passage 153. The paper sheet P fed into the sheet passage 153 is fed from the lower side of the sheet passage 153 to the upper side thereof while being pinched by the pairs of feed rollers 154.

A pair of registration rollers 55 is arranged on the downstream side of the sheet passage 153 relative to the sheet feeding direction. When the pair of registration rollers 55 pinches the tip of the paper sheet P thus fed by the pairs of feed rollers 154, the pair of registration rollers 55 is stopped once, and is then rotated again to timely feed the paper sheet P to a secondary transfer nip mentioned below so that a combined color toner image on the intermediate transfer belt 14 is transferred onto the predetermined position of the paper sheet P.

Figure 3:
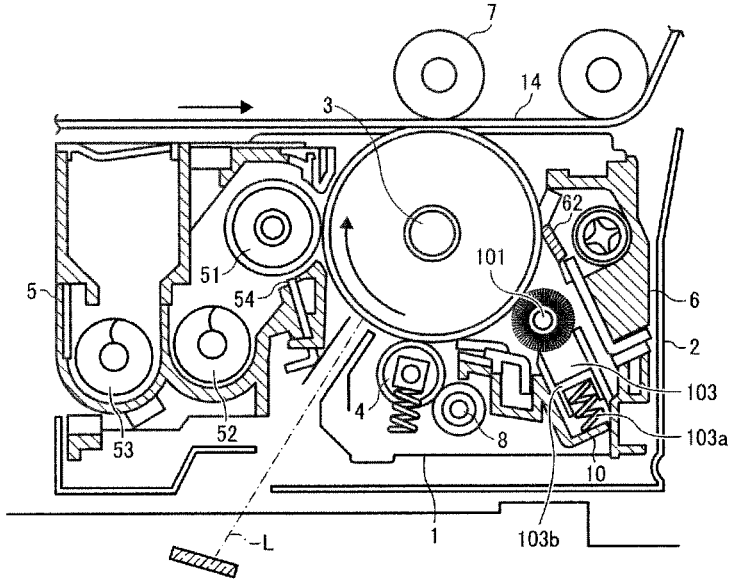
FIG. 3 is a schematic cross-sectional view illustrating an image forming unit of the image forming apparatus illustrated in FIG. 2.

FIG. 3 illustrates one of the four image forming units 1. As illustrated in FIG. 3, the image forming unit 1 includes a drum-shaped photoreceptor 3 serving as an image bearing member. The shape of the photoreceptor 3 is not limited thereto, and sheet-shaped photoreceptors, endless belt-shaped photoreceptors and the like can also be used.

Around the photoreceptor 3, a charging roller 4, a developing device 5, a primary transfer roller 7, a cleaner 6, a lubricant applicator 10, a discharging lamp (not shown), etc., are arranged. The charging roller 4 serves as charging means for charging a surface of the photoreceptor 3. The developing device 5 serves as developing means for developing an electrostatic latent image formed on the photoreceptor 3 with a developer to form a toner image thereon. The primary transfer roller 7 serves as primary transferring means for transferring the toner image on the photoreceptor 3 to the intermediate transfer belt 14. The cleaner 6 serves as cleaning means for removing residual toner from the surface of the photoreceptor 3 after transferring the toner image. The lubricant applicator 10 serves as lubricant applying means for applying a lubricant to the surface of the photoreceptor 3 after cleaning the surface. The discharging lamp (not shown) serves as discharging means for decaying residual charges remaining on the surface of the photoreceptor 3 after cleaning the surface.

The charging roller 4 is arranged in the vicinity of the photoreceptor 3 with a predetermined gap therebetween, and evenly charges the photoreceptor 3 so that the photoreceptor 3 has a predetermined potential with a predetermined polarity. The thus evenly charged surface of the photoreceptor 3 is irradiated with the light beam L emitted by the optical writing unit 40 based on image information, thereby forming an electrostatic latent image on the surface of the photoreceptor 3.

The developing device 5 has a developing roller 51 serving as a developer bearing member. A development bias is applied to the developing roller 51 by a power source (not shown). A supplying screw 52 and an agitating screw 53 are provided in a casing of the developing device 5 to feed the developer in opposite directions in the casing so that the developer is charged so as to have a charge with a predetermined polarity. In addition, a doctor 54 is provided in the developing device to form a developer layer having a predetermined thickness on the surface of the developing roller 51. The layer of the developer, which has been charged so as to have a charge with the predetermined polarity, is adhered to an electrostatic latent image on the photoreceptor 3 at a development region, in which the developing roller 51 is opposed to the photoreceptor 3, resulting in formation of a toner image on the surface of the photoreceptor 3.

The cleaner 6 includes a fur brush 101, the cleaning blade 62, etc. The cleaning blade 62 is contacted with the surface of the photoreceptor 3 in such a manner as to counter the rotated photoreceptor 3. The cleaning blade 62 will be described later in detail.

The lubricant applicator 10 includes a solid lubricant 103, and a pressing spring 103*a* to press the solid lubricant 103 toward the fur brush 101 serving as a lubricant applicator to apply the lubricant to the surface of the photoreceptor 3. The solid lubricant 103 is supported by a bracket 103*b* while being pressed toward the fur brush 101 by the pressing spring 103*a*. The solid lubricant 103 is scraped by the fur brush 101, which is driven by the photoreceptor 3 so as to rotate (counterclockwise in FIG. 3), thereby applying the lubricant 103 to the surface of the photoreceptor 3. By thus applying the lubricant, the friction coefficient of the surface of the photoreceptor 3 can be controlled so as to be not higher than 0.2.

Although the non-contact short-range charging roller 4 is used as the charger of the image forming unit 1, the charger is not limited thereto, and contact chargers (such as contact charging rollers), corotrons, scorotrons, solid state chargers, and the like can also be used for the charger. Among these chargers, contact chargers, and non-contact short-range chargers are preferable because of having advantages such that the charging efficiency is high, the amount of ozone generated in a charging operation is small, and the charger can be miniaturized.

Specific examples of light sources for use in the optical writing unit 40 include any known light emitting devices such as fluorescent lamps, tungsten lamps, halogen lamps, mercury lamps, sodium lamps, light emitting diodes (LEDs), laser diodes (LDs), electroluminescent lamps (ELs), and the like.

In order to irradiate the photoreceptor 3 with light having a wavelength in a desired range, sharp cut filters, bandpass filters, infrared cut filers, dichroic filters, interference filters, color temperature converting filters, and the like can be used.

Among these light sources, LEDs and LDs are preferably used because of having advantages such that the irradiation energy is high, and light having a relatively long wavelength of from 600 nm to 800 nm can be emitted.

The transfer unit 60 serving as transferring means includes not only the intermediate transfer belt 14, but also a belt cleaning unit 162, a first bracket 63, and a second bracket 64. In addition, the transfer units 60 further includes four primary transfer rollers 7Y, 7C, 7M and 7K, a secondary transfer backup roller 66, a driving roller 67, a supplementary roller 68, and a tension roller 69. The intermediate transfer belt 14 is rotated counterclockwise in an endless manner by the driving roller 67 while being tightly stretched by the four rollers. The four primary transfer rollers 7Y, 7C, 7M and 7K press the thus rotated intermediate transfer belt 14 toward the photoreceptors 3Y, 3C, 3M and 3K, respectively, to form four primary transfer nips. In addition, a transfer bias having a polarity opposite that of the charge of the toner is applied to the backside (i.e., inner surface) of the intermediate transfer belt (for example, a positive bias is applied when a negative toner is used). Since the intermediate transfer belt 14 is rotated endlessly, yellow, cyan, magenta and black toner images, which are formed on the photoreceptors 3Y, 3C, 3M and 3K, respectively, are sequentially transferred onto the intermediate transfer belt 14 so as to be overlaid, resulting in formation of a combined color toner image on the intermediate transfer belt 14.

The secondary transfer backup roller 66 and a secondary transfer roller 70 sandwich the intermediate transfer belt 14 to form a secondary transfer nip. As mentioned above, the pair of registration rollers 55 pinches the transfer paper sheet P once, and then timely feeds the paper sheet P toward the secondary transfer nip so that the combined color toner image on the intermediate transfer belt 14 is transferred onto a predetermined position of the paper sheet P. Specifically, the entire combined color toner image is transferred due to a secondary transfer electric field formed by the secondary transfer roller 70, to which a secondary transfer bias is applied, and the secondary transfer backup roller 66, and a nip pressure applied between the secondary transfer roller 70 and the transfer backup roller 66, resulting in formation of a full color toner image on the paper sheet P having white color.

After passing the secondary transfer nip, the intermediate transfer belt 14 bears residual toners (i.e., non-transferred toners) on the surface thereof. The belt cleaning unit 162 removes the residual toners from the surface of the intermediate transfer belt 14. Specifically, a belt cleaning blade 162*a* of the belt cleaning unit 162 is contacted with the surface of the intermediate transfer belt 14 to removes the residual toners therefrom.

The first bracket 63 of the transfer unit 60 is rotated at a predetermined rotation angle on a rotation axis of the supplementary roller 68 by being driven by an on/off operation of a solenoid (not shown). When a monochromatic image is formed, the printer 500 slightly rotates the first bracket 63 counterclockwise by driving the solenoid. When the first bracket 63 is thus rotated, the primary transfer rollers 7Y, 7C and 7M are moved counterclockwise around the rotation axis of the supplementary roller 68, thereby separating the intermediate transfer belt 14 from the photoreceptors 3Y, 3C and 3M. Thus, only the black image forming unit 1K is operated (without driving the color image forming units 1Y, 1C and 1M) to form a monochromatic image. By using this method, the life of the parts of the color image forming units 1Y, 1C and 1M can be prolonged.

As illustrated in FIG. 2, a fixing unit 80 is provided above the secondary transfer nip. The fixing unit 80 includes a pressure/heat roller 81 having a heat source (such as a halogen lamp) therein, and a fixing belt unit 82. The fixing belt unit 82 includes an endless fixing belt 84 serving as a fixing member, a heat roller 83 having a heat source (such as a halogen lamp) therein, a tension roller 85, a driving roller 86, a temperature sensor (not shown), and the like. The endless fixing belt 84 is counterclockwise rotated endlessly by the driving roller 86 while being tightly stretched by the heat roller 83, the tension roller 85 and the driving roller 86. When the fixing belt 84 is rotated, the fixing belt is heated by the heat roller 83 from the backside thereof. The pressure/heat roller 81 is contacted with the front surface of the fixing belt 84 while pressing the fixing belt 84 to the heat roller 83, resulting in formation of a fixing nip between the pressure/heat roller 81 and the fixing belt 84.

A temperature sensor (not shown) is provided so as to be opposed to the front surface of the fixing belt 84 with a predetermined gap therebetween to detect the temperature of the fixing belt 84 at a location just before the fixing nip. The detection data are sent to a fixing device supply circuit (not shown). The fixing device supply circuit performs ON/OFF control on the heat source in the heat roller 83 and the heat source in the pressure/heat roller 81.

The transfer paper sheet P passing the secondary transfer nip and separated from the intermediate transfer belt 14 is fed to the fixing unit 80. When the paper sheet P bearing the unfixed full color toner image thereon is fed from the lower side of the fixing unit 80 to the upper side thereof while being sandwiched by the fixing belt 14 and the pressure/heat roller 81, the paper sheet P is heated by the fixing belt 84 while being pressed by the pressure/heat roller 81, resulting in fixation of the full color toner image on the paper sheet P.

The paper sheet P thus subjected to a fixing treatment is discharged from the main body of the printer 500 by a pair of discharging rollers 87 so as to be stacked on a surface of a stacking portion 88.

Four toner cartridges 100Y, 100C, 100M and 100K respectively containing yellow, cyan, magenta and black color toners are provided above the transfer unit 60 to supply the yellow, cyan, magenta and black color toners to the corresponding developing devices 5Y, 5C, 5M and 5K of the image forming units 1Y, 1C, 1M and 1K, if desired. These toner cartridges 100Y, 100C, 100M and 100K can be detachably attachable to the main body of the printer 500 independently of the image forming units 1Y, 1C, 1M and 1K.

Next, the image forming operation of the printer 500 will be described.

Upon receipt of a print execution signal from an operating portion (not shown) such as an operation panel, predetermined voltages or currents are applied to the charging roller 4 and the developing roller 51 at predetermined times. Similarly, predetermined voltages or currents are applied to the light sources of the optical writing unit 40 and the discharging lamp. In synchronization with these operations, the photoreceptors 3 are rotated in a direction indicated by an arrow by a driving motor (not shown).

When the photoreceptors 3 are rotated, the surfaces thereof are charged by the respective charging rollers 4 so as to have predetermined potentials. Next, light beams L (such as laser beams) emitted by the optical writing unit 40 irradiate the charged surfaces of the photoreceptors 3, thereby forming electrostatic latent images on the surface of the photoreceptors 3.

The surfaces of the photoreceptors 3 bearing the electrostatic latent images are rubbed by magnetic brushes of the respective developers formed on the respective developing rollers 51. In this case, the (negatively-charged) toners on the developing rollers 51 are moved toward the electrostatic latent images by the development biases applied to the developing rollers 51, resulting in formation of color toner images on the surface of the photoreceptors 3Y, 3C, 3M and 3K.

Thus, each of the electrostatic latent images formed on the photoreceptors 3 is subjected to a reverse development treatment using a negative toner. In this example, a N/P developing method using a non-contact charging roller is used, but the developing method is not limited thereto.

The color toner images formed on the surfaces of the photoreceptors 3Y, 3C, 3M and 3K are primarily transferred to the intermediate transfer belt 14 so as to be overlaid, thereby forming a combined color toner image on the intermediate transfer belt 14.

The combined color toner image thus formed on the intermediate transfer belt 14 is transferred onto a predetermined portion of the paper sheet P, which is fed from the first or second cassette 151 or 152 and which is timely fed to the secondary transfer nip by the pair of registration rollers 55 after being pinched thereby. After the paper sheet P bearing the combined color toner image thereon is separated from the intermediate transfer belt 14, the paper sheet P is fed to the fixing unit 80. When the paper sheet P bearing the combined color toner image thereon passes the fixing unit 80, the combined toner image is fixed to the paper sheet P upon application of heat and pressure thereto. The paper sheet P bearing the fixed combined color toner image (i.e., a full color image) thereon is discharged from the main body of the printer 500, resulting in stacking on the surface of the stacking portion 88.

Toners remaining on the surface of the intermediate transfer belt 14 even after the combined color toner image thereon is transferred to the paper sheet P are removed therefrom by the belt cleaning unit 162.

Toners remaining on the surfaces of the photoreceptors 3 even after the color toner images thereon is transferred to the intermediate transfer belt 14 are removed therefrom by the cleaner 6. Further, the surfaces of the photoreceptors 3 are coated with a lubricant by the lubricant applicator 10, followed by a discharging treatment using a discharging lamp.

As illustrated in FIG. 3, the photoreceptor 3, the charging roller 4, the developing device 5, the cleaner 6, the lubricant applicator 10, and the like are contained in a case 2 of the image forming unit 1 of the printer 500. The image forming unit 10 is detachable attachable to the main body of the printer 500 as a single unit (i.e., process cartridge). However, the image forming unit 1 is not limited thereto, and may have a configuration such that each of the members and devices such as the photoreceptor 3, charging roller 4, developing device 5, cleaner 6, and lubricant applicator 10 is replaced with a new member or device.

Next, the toner for use in the printer 500 (i.e., the image forming apparatus of the present invention) will be described.

The toner is preferably a toner having a high circularity and a small particle diameter. Such a toner can be preferably prepared by polymerization methods such as suspension polymerization methods, emulsion polymerization methods, dispersion polymerization methods, and the like. The average circularity of the toner is preferably not less than 0.97, and the volume resistivity thereof is preferably not greater than 5.5 μm to produce high resolution toner images.

The average circularity of the toner is measured using a flow particle image analyzer FPIA-2000 from Sysmex Corp. The procedure is as follows:

(1) initially, 100 to 150 ml of water, from which solid foreign materials have been removed, 0.1 to 0.5 ml of a surfactant (e.g., alkylbenzenesulfonate) and 0.1 to 0.5 g of a sample (i.e., toner) are mixed to prepare a dispersion;

(2) the dispersion is further subjected to a supersonic dispersion treatment for 1 to 3 minutes using a supersonic dispersion machine to prepare a dispersion including particles at a concentration of from 3,000 to 10,000 pieces/μl;

(3) the dispersion set in the analyzer so as to be passed through a detection area formed on a plate in the analyzer; and (4) the particles of the sample passing through the detection area are optically detected by a CCD camera and then the shapes of the toner particles and the distribution of the shapes are analyzed with an image analyzer to determine the average circularity of the sample.

Figure 4A:
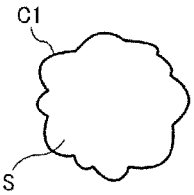
FIG. 4 is a schematic view for explaining the way to determine the circularity of toner.
Figure 4B:
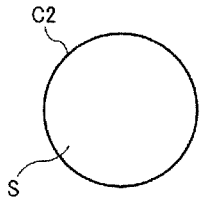

The method for determining the circularity of a particle will be described by reference to FIG. 4. When the projected image of a particle has a peripheral length C1 and an area S as illustrated in FIG. 4(*a*), and the peripheral length of the circle having the same area S is C2 as illustrated in FIG. 4(*b*), the circularity of the particle is obtained by the following equation.

$$\text{Circularity}=C2/C1$$

The average circularity of the toner is obtained by averaging circularities of particles.

The volume average particle diameter of toner can be measured, for example, by an instrument such as COULTER MULTICIZER 2e manufactured by Beckman Coulter Inc. Specifically, the number-based particle diameter distribution data and the volume-based particle diameter distribution data are sent to a personal computer via an interface manufactured by Nikkaki Bios Co., Ltd. to be analyzed. The procedure is as follows:

(1) a surfactant serving as a dispersant, preferably 0.1 to 5 ml of a 1% aqueous solution of an alkylbenzenesulfonic acid salt, is added to an electrolyte such as 1% aqueous solution of first class NaCl;

(2) 2 to 20 mg of a sample (toner) to be measured is added into the mixture;

(3) the mixture is subjected to an ultrasonic dispersion treatment for about 1 to 3 minutes; and (4) the dispersion is added to 100 to 200 ml of an aqueous solution of an electrolyte in a beaker so that the mixture includes the particles at a predetermined concentration;

(5) the diluted dispersion is set in the instrument to measure particle diameters of 50,000 particles using an aperture of 100 nm to determine the volume average particle diameter.

In this regard, the following 13 channels are used:

(1) not less than 2.00 μm and less than 2.52 μm;
(2) not less than 2.52 μm and less than 3.17 μm;
(3) not less than 3.17 μm and less than 4.00 μm;
(4) not less than 4.00 μm and less than 5.04 μm;
(5) not less than 5.04 μm and less than 6.35 μm;
(6) not less than 6.35 μm and less than 8.00 μm;
(7) not less than 8.00 μm and less than 10.08 μm;
(8) not less than 10.08 μm and less than 12.70 μm;
(9) not less than 12.70 μm and less than 16.00 μm;
(10) not less than 16.00 μm and less than 20.20 μm;
(11) not less than 20.20 μm and less than 25.40 μm;
(12) not less than 25.40 μm and less than 32.00 μm; and
(13) not less than 32.00 μm and less than 40.30 μm.

Namely, particles having a particle diameter of from 2.00 μm to 40.30 μm are targeted.

In this regard, the volume average particle diameter is obtained by the following equation.

$$\text{Volume average particle diameter}=\Sigma XfV/\Sigma fV,$$

wherein X represent the representative particle diameter of each channel, V represents the volume of the particle having the representative particle diameter, and f represents the number of particles having particle diameters in the channel.

Figure 8:
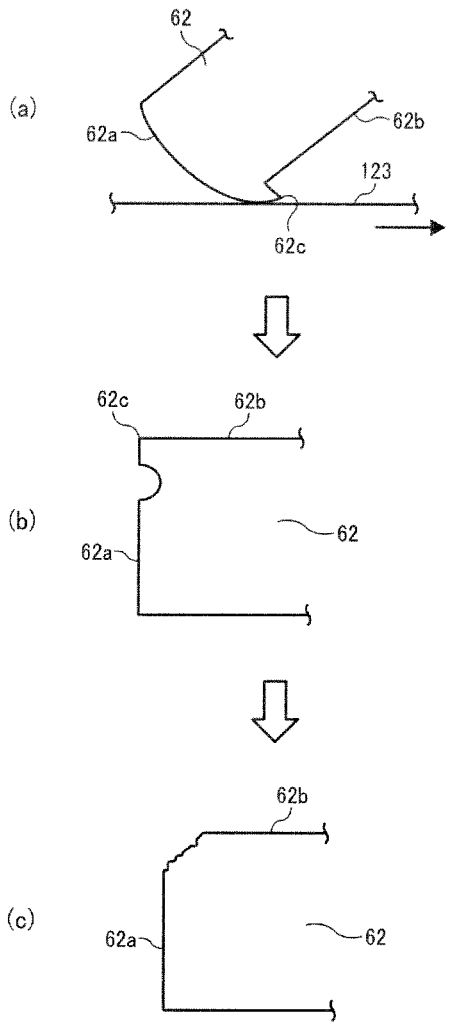
FIG. 8 RELATED ART
FIGS. 8(*a*)-8(*c*) are schematic views for explaining how a cleaning blade is damaged.

When such a polymerization toner as mentioned above is used, residual toner remaining on the photoreceptor 3 cannot be satisfactorily removed therefrom using a cleaning blade compared to a case where a conventional pulverization toner is used, thereby easily forming an abnormal image in which background thereof is soiled with residual toner. In attempting to improve the cleanability (i.e., to prevent formation of such an abnormal image) by increasing the contact pressure of the cleaning blade 62 to the photoreceptor 3, another problem in that the cleaning blade is rapidly abraded is caused. In this case, friction between the cleaning blade 62 and the photoreceptor 3 is increased, and thereby the tip of the cleaning blade is pulled by the photoreceptor 3 in the moving direction of the photoreceptor as mentioned above by reference to FIG. 8(*a*). In this regard, the thus everted tip has a restoring force, and the tip tends to vibrate, resulting in generation of fluttering sounds. In addition, when the cleaning blade 62 in such a state is continuously used, the cleaning blade may lack the edge portion thereof as illustrated in FIG. 8(*c*).

Figure 1A:
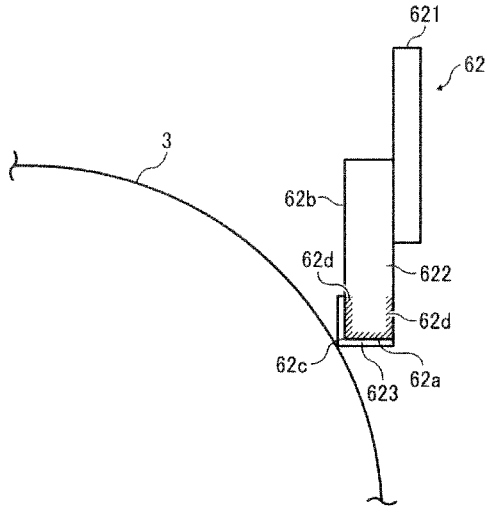
FIGS. 1A and 1B are schematic cross-sectional views illustrating an example of the cleaning blade of this disclosure.
Figure 1B:
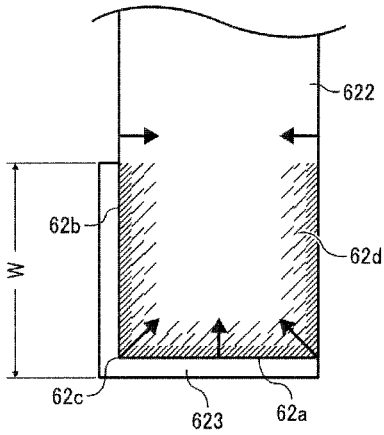
Figure 5:
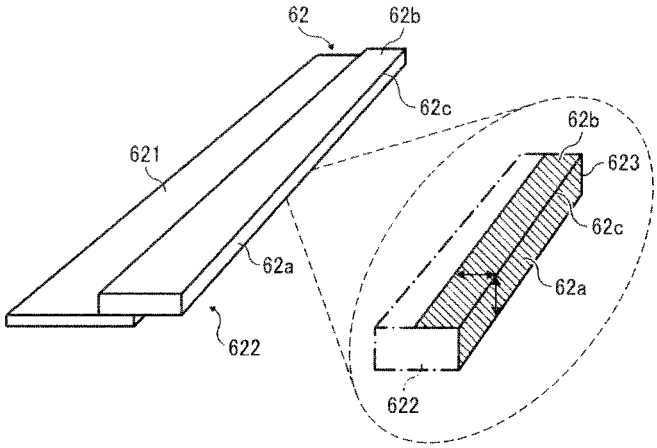
FIG. 5 is a schematic perspective view illustrating an example of the cleaning blade of this disclosure.

FIG. 5 is a perspective view illustrating an example of the cleaning blade of this application, and FIGS. 1A and 1B are enlarged cross-sectional views illustrating the cleaning blade. FIG. 1A illustrates the cleaning blade 62 contacted with a surface of the photoreceptor 3, and FIG. 1B is an enlarged cross-sectional view illustrating the tip of the cleaning blade 62.

Referring to FIGS. 5, 1A and 1B, the cleaning blade 62 includes a strip-shaped holder 621 which is made of a rigid material such as metals and hard plastics, and a strip-shaped elastic blade 622. The elastic blade 622 has an edge portion 62*c*, which is subjected to an impregnation treatment as mentioned below in detail. In addition, an outermost layer 623 is formed on each of surfaces of a tip 62*a* and an upper portion of a lower surface 62*b* of the blade 62. As illustrated in FIG. 5, the outermost layer 623 extends in the longitudinal direction of the blade 62.

The elastic blade 622 is fixed to an upper end portion of the holder 621, for example, by an adhesive. The other end portion (i.e., the lower end portion) of the holder 621 is supported (cantilevered) by a case of the cleaner 6.

In order that the elastic blade 622 can be satisfactorily contacted with the surface of the photoreceptor 3 even if the photoreceptor 3 is eccentric or the surface thereof is waved, the elastic blade 622 preferably has a high resilience coefficient, and rubbers having a urethane group such as urethane rubbers are preferably used therefor.

In addition, the elastic blade 622 preferably has a JIS A hardness of from 66° to 77° at 25° C., and urethane rubbers having such a hardness are preferably used therefor. When the hardness is higher than 77°, the blade tends to lack flexibility. Specifically, when such a hard blade is attached to the holder while being slanted, the end portions of the blade in the longitudinal (axis) direction thereof are contacted with the photoreceptor 3 at different contact pressures, resulting in defective cleaning (i.e., deterioration of the cleanability of the cleaning blade). In contrast, when the hardness is lower than 66°, the tip of the cleaning blade tends to be everted if the contact pressure is increased to satisfactorily remove a polymerization toner from the surface of the photoreceptor 3. In this case, a portion of the lower surface 62*b* of the cleaning blade 62 is contacted with the surface of the photoreceptor 3, thereby seriously increasing the contact area of the cleaning blade with the photoreceptor (i.e., seriously decreasing the contact pressure of the cleaning blade), resulting in deterioration of the cleanability of the cleaning blade 62.

In this regard, since the hardness of the elastic blade 622 is affected by the impregnation treatment (e.g., the thickness of the impregnated portion, and the material used for the impregnation treatment), and the outermost layer 623 (e.g., the thickness of the layer and the material used for forming the layer), it is preferably to control the hardness so as to fall in the preferable range by optimizing these factors.

The impregnation treatment for the edge 62*c* of the elastic blade 622 is typically performed by impregnating the edge with an ultraviolet crosslinkable resin using a coating method such as brush coating, spray coating and dip coating. By performing this impregnation treatment on the elastic blade 622, occurrence of the deformation problem in that the edge 62*c* of the elastic blade 622 contacted with the photoreceptor 3 is deformed in the moving direction of the photoreceptor 3 can be prevented. In addition, even when the surface portion of the blade is abraded to an extent such that an internal portion of the blade is exposed, occurrence of the deformation problem can be prevented because the ultraviolet crosslinkable resin penetrates into the internal portion of the elastic blade 622 as illustrated by arrows and shading in FIG. 1.

After the elastic blade 622 is impregnated with an ultraviolet crosslinkable resin, followed by natural drying for a predetermined period, the outermost layer 623 is formed on the surface of the resin-impregnated portion of the blade using a method such as spray coating, dip coating, and screen printing to cover the edge 62*c* and the surface of a tip portion of the elastic blade 622 as illustrated in FIG. 1. The outermost layer 623 is constituted of a material, which is harder than the elastic blade and which preferably has a pencil hardness of from 7H to 9H. Therefore, the outermost layer 623 is harder, more rigid, and less deformable than the elastic blade 622, and can prevent the cleaning blade 62 from causing the everted-tip problem.

After the elastic blade 622 is subjected to the impregnation treatment and then the outermost layer is formed thereon, the elastic blade 622 is irradiated with ultraviolet rays. Thus, a crosslinked resin-impregnated portion 62*d* is formed in the surface portion of the elastic blade 622 as illustrated in FIG. 1, thereby enhancing the hardness of the edge 62*c* of the blade. It is disclosed in a published Japanese patent application JP 2010-152295A that a surface portion of an elastic blade is impregnated with a material such as isocyanate compounds, fluorine-containing compounds, and silicone compounds to enhance the durability of the blade. In this disclosure, by subjecting an elastic blade to an impregnation treatment using an ultraviolet crosslinkable resin, the durability of the blade can be further enhanced. The reasons therefor are considered to be as follows.

Specifically, by subjecting an elastic blade to an impregnation treatment using an ultraviolet crosslinkable resin, a network of chains of a crosslinked resin is formed in the elastic blade. Therefore, the cross-linkage density of the rubber is apparently increased, thereby increasing the abrasion resistance of the blade. In this regard, it is important that the ultraviolet crosslinkable resin is hardly reacted with the urethane rubber of the elastic blade. In contrast, in a conventional impregnation treatment using an isocyanate compound, the isocyanate is chemically reacted with the urethane rubber, thereby excessively increasing the cross-linkage density of the rubber. Therefore, the rubber achieves a near-glass state instead of a rubber state, and movement of the edge thereof is excessively restricted, thereby deteriorating the abrasion resistivity of the blade.

Another reason therefor is considered as follows. Specifically, when an ultraviolet crosslinkable resin is used for the outermost layer, the resin-impregnated portion 62*d* produces an anchor effect, and enhances adhesion between the elastic rubber blade 622 and the outermost layer 623, thereby enhancing the durability of the blade 62.

In this example, the cleaning blade 62 is prepared by impregnating the base material (i.e., urethane rubber) of the elastic blade 622 with an ultraviolet crosslinkable resin using dip coating, and then applying an ultraviolet crosslinkable resin on a portion of the resin-impregnated portion of the base material by spray coating, followed by a crosslinking treatment using ultraviolet rays.

In this regard, the base material impregnated with the ultraviolet crosslinkable resin may be subjected to a crosslinking treatment to crosslink the ultraviolet resin before forming the outermost layer 623. By using this method, the conditions of the resin-impregnated portion of the blade are hardly changed even when an outermost layer coating liquid is applied thereon because the resin-impregnated portion has been crosslinked. Therefore, an elastic blade having a desired resin-impregnated portion can be prepared.

In this example, the impregnation treatment using an ultraviolet crosslinkable resin is performed such that there is concentration gradient of the ultraviolet crosslinked resin in the surface portion of the elastic blade 622, i.e., the concentration of the crosslinked resin decreases in a direction of from the surface of the blade toward the inner portion thereof as illustrated by shading in FIG. 1B. A blade having such a crosslinked resin concentration gradient can be prepared, for example, by performing an impregnation treatment in a short period of time, or by using an ultraviolet crosslinkable resin having a low penetrating speed. In this example, the impregnation treatment is performed for 30 seconds using dip coating.

It is possible to prepare a blade having no crosslinked resin concentration gradient, for example, by performing the impregnation treatment for a long period of time so that the penetrated resin achieves an equilibrium state in the blade. However, in this disclosure, by controlling the amount of an ultraviolet crosslinkable resin in the impregnation treatment, the crosslinked resin concentration gradient is formed in the blade.

In addition, in the cleaning blade 62 of this disclosure, the outermost layer 623 harder than the elastic blade 622 is formed on a surface of a tip of the blade to reduce friction coefficient of the edge 62*c* of the blade with the surface of the photoreceptor 3.

In this regard, a blade, in which the outermost layer 623 harder than the base material of the blade is formed thereon without impregnating the base material with an ultraviolet crosslinkable resin, will be described for comparison. Specifically, even when such a hard outermost layer is formed to reduce friction coefficient, the outermost layer 623 is abraded after repeated use. In this case, if a thick outermost layer is formed to prolong the life of the blade, the thick outermost layer prevents elastic deformation of the edge 62*c* of the elastic blade 622, thereby often causing defective cleaning. In contrast, if a thin outermost layer is formed not to prevent such elastic deformation, the outermost layer 623 is abraded in a short period of time and the base material having lower hardness is exposed. When the base material is directly contacted with the surface of the photoreceptor 3, friction between the cleaning blade 62 and the surface of the photoreceptor 3 increases, thereby causing abnormal abrasion of the blade and/or generation of fluttering sounds.

In contrast, in this example of the cleaning blade of this disclosure, a crosslinked resin is present in the surface portion of the blade, which is located below the outermost layer, while having concentration gradient, thereby properly enhancing the mechanical strength of the base material (i.e., elastic rubber such as urethane rubber). Therefore, movement of the tip of the blade can be properly controlled, and the blade can provide good cleaning performance while preventing abnormal abrasion of the blade and/or generation of fluttering sounds. Thus, the blade can provide good cleaning performance while having good abrasion resistance (long life).

Further, in a blade, in which the outermost layer 623 harder than the blade is formed on a base material which is not subjected to the impregnation treatment, the hardness of the blade sharply changes at the interface between the hard outermost layer and the base material, resulting in concentration of a stress at the interface, thereby often damaging the blade. In contrast, since the surface portion of the blade has crosslinked resin concentration gradient in this example of the cleaning blade of this disclosure, concentration of a stress at the interface can be prevented, resulting in prevention of damaging of the blade.

A Japanese patent No. 3602898 discloses a blade having only a cover layer thereon and another blade which is impregnated with a resin material and has no cover layer. A blade having only a cover layer has such drawbacks as mentioned above. In contrast, a blade impregnated with a resin material and having no cover layer has a surface having lower hardness than a blade having a hard cover layer, and therefore the blade has insufficient abrasion resistance. Since the resin used therefor has a pencil hardness of from B to 6H, the hardness of the blade is insufficient, and the blade has poor durability. When the thickness of the outermost layer is increased to enhance the durability, the edge of the blade cannot be contacted in a desired manner with the surface of a photoreceptor, resulting in deterioration of the durability of the blade.

A published Japanese patent application No. 2004-233818 discloses a cleaning blade which is impregnated with a silicone-containing ultraviolet crosslinkable resin so that the resultant crosslinked resin has concentration gradient and the surface of the blade is covered with the crosslinked resin. Therefore, the cleaning blade is different from the cleaning blade of this disclosure in which the cover layer is formed independently of the impregnation treatment. In addition, silicone-containing ultraviolet crosslinked resins are inferior in durability to such resins as used for the outermost layer of the cleaning blade of this disclosure. Further, when the impregnation treatment is performed for 12 hours as described in JP 2004-233818A, the blade is impregnated with an excessive amount of ultraviolet crosslinkable resin, and the base material (rubber) of the blade is excessively swelled, thereby damaging the network of the base material, resulting in deterioration of the mechanical strength and durability of the blade.

As mentioned above, the elastic blade 622 of the cleaning blade 62 of this disclosure has the outermost layer 623 constituted of an ultraviolet crosslinked resin having a pencil hardness of not less than 7H, and a surface portion of the base material of the elastic blade 622 is impregnated with an ultraviolet crosslinked resin with concentration gradient. Since the elastic blade 622 is impregnated with an ultraviolet crosslinked resin and has high hardness, the cleaning blade 62 has good durability even when the outermost layer 623 is relatively thin. Thus, the outermost layer 623 is relatively thin while having high pencil hardness, the edge 62*c* of the blade 62 can be contacted with the surface of a photoreceptor in a desired manner while having good durability. Therefore, the cleaning blade 62 has good durability. In addition, since the amount of the ultraviolet crosslinked resin penetrating into the elastic blade 622 is controlled so as not to be large, deterioration of the mechanical strength of the base material (rubber) due to swelling of the rubber caused by penetration of a large amount of the ultraviolet crosslinked resin can be prevented while strengthening the network of the base material by impregnating the base material with a proper amount of the ultraviolet crosslinked resin.

As mentioned above, since the hardness of the edge 62*c* of the elastic blade 622 is increased by the impregnation treatment, the edge 62*c* becomes less deformable than ever. If the outermost layer 623 is formed on the entire surface of the lower surface 62*b* of the thus resin-impregnated elastic blade 622, elastic deformation of the edge 62*c* is restricted, and the restoring force of the edge 62*c* in such a direction as to enhance the contact pressure of the blade is weakened. In this case, the edge 62*c* cannot be satisfactorily contacted with the surface of the photoreceptor 3 even if the photoreceptor is eccentric or the surface thereof is waved, thereby causing defective cleaning such that residual toner on the surface of the photoreceptor 3 passes through the gap between the cleaning blade and the surface of the photoreceptor.

If the outermost layer 623 is not formed on the lower surface 62*b* of the elastic blade to avoid the above-mentioned problem, the edge 62*c* of the elastic blade 622 is greatly deformed in the moving direction of the photoreceptor 3, thereby causing the everted-tip problem, resulting in abrasion of the blade as illustrated in FIG. 8(*b*).

Therefore, in this example of the cleaning blade of this disclosure, an outermost layer 623 having a thickness of 1 μm and a length of 50 μm is formed on each of the tip 62*a* and a front portion of the lower surface 62*b* starting from the edge 62*c* as illustrated in FIG. 1. In this cleaning blade, the edge 62*c* is properly deformed in the moving direction of the photoreceptor 3 while preventing the edge from being everted unlike the blade in which the outermost layer is formed on the entire surface of the lower surface 62*b*. Therefore, the cleaning blade can be satisfactorily contacted with the surface of the photoreceptor 3 even if the photoreceptor is eccentric or the surface thereof is waved, and can provide good performance over a long period of time.

Suitable materials for use in the outermost layer 623 include resins. More preferably, the outermost layer is constituted of an ultraviolet crosslinked resin because an outermost layer having desired hardness can be easily prepared by adhering an ultraviolet crosslinkable resin to the edge 62*c* and then irradiating the ultraviolet crosslinkable resin with ultraviolet rays. Namely, a desired cleaning blade can be prepared at low costs.

In order to prepare such an ultraviolet crosslinked resin, monomers having a pentaerythritol triacrylate skeleton as a main skeleton and having a functional group-equivalent molecular weight, which is defined as a ratio (MW/FG) of the molecular weight (MW) of the monomer to the number (FG) of functional groups of the monomer, while having from 3 to 6 functional groups are preferably used. When monomers having a functional group-equivalent molecular weight of greater than 350 or a skeleton other than the pentaerythritol triacrylate skeleton are used as ultraviolet crosslinkable resins, the resultant outermost layer 623 tends to become too brittle, thereby causing the everted-tip problem, resulting in abrasion of the tip of the blade as illustrated in FIG. 8(*b*).

In addition, it is preferable to use a combination of such a pentaerythritol triacrylate monomer as mentioned above with an acrylate monomer having a functional group equivalent molecular weight of from 100 to 1,000 while having one or two functional groups for forming the outermost layer 623, to impart good flexibility to the outermost layer. Namely, by controlling the added amount of such an acrylate monomer, it becomes possible to adjust the properties of the outermost layer 623 so as to be suitable for the machines for which the cleaning blade is used. For example, even when a cleaning blade causes the fluttering sound problem under specific environmental conditions, the problem can be easily avoided by adjusting the properties of the outermost layer 623 by adjusting the added amount of the monomer.

The thickness of the outermost layer 623 is preferably not greater than 1 μm when measured at a position apart from the edge 62*c* by 50 μm. When the thickness is greater than 1 μm, the rigidity of the outermost layer 623 excessively increases, and thereby the movement (vibration) of the edge 62*c* on the surface of the photoreceptor 3 becomes too little. In this case, the vibration energy is concentrated at the edge 62*c*, resulting in generation of noises and increase of the abrasion speed (i.e., shortening of the life of the blade).

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The following verification experiments were performed.

Specifically, a number of blades were prepared by changing the base material of the elastic blade 622, the material of the outermost layer 623, the depth of the resin-impregnated portion (i.e., the method of the impregnation treatment), and the thickness of the outermost layer (for example, by changing the solid content of the coating liquid, the moving speed of the spray gun, the distance between the spray gun and the base material, and the number of spray coating operations).

I. Constituent Material of Elastic Blade 622

The following materials were used for the elastic blade 622.

| Material | Hardness (°) at 25° C. | Resilience coefficient (%) at 25° C. | Manufacturer |
|---|---|---|---|
| Urethane rubber 1 | 66 | 46 | Bando Chemical Industries, Ltd. |
| Urethane rubber 2 | 70 | 50 | Toyo Tire & Rubber Co., Ltd. |
| Urethane rubber 3 | 72 | 31 | Toyo Tire & Rubber Co., Ltd. |
| Urethane rubber 4 | 75 | 21 | Toyo Tire & Rubber Co., Ltd. |
| Urethane rubber 5 | 77 | 19 | Synztec Co., Ltd. |

The hardness of the urethane rubbers 1-5 was measured by a method defined in JIS K6253 using a durometer manufactured by Shimadzu Corp. When measuring the hardness, sheets (with a thickness of about 2 mm) of each of the urethane rubbers were overlaid so that the rubber has a thickness of not less than 12 mm.

The resilience coefficient of the urethane rubbers 1-5 was measured by a method defined in JIS K6255 using a resilience tester No. 221 manufactured by Toyo Seiki Seisaku-Sho Ltd. When measuring the resilience coefficient, sheets (with a thickness of about 2 mm) of each of the urethane rubbers were overlaid so that the rubber has a thickness of not less than 4 mm.

II. Coating Liquid for Impregnation Treatment and for Forming Outermost Layer 623

The following crosslinkable resins, initiators and solvents were used for forming the outermost layer 623.

1. Coating Liquid 1

The formula of the coating liquid 1 is as follows.

| | |
|---|---|
| Ultraviolet crosslinkable resin (PETIA from DAICEL-CYTEC Co., Ltd.) | 10 parts |
| Polymerization initiator (IRGACURE 184 from Ciba Specialty Chemicals) | 1 part |
| 2-Butanone | 89 parts |

2. Coating Liquid 2

The formula of the coating liquid 2 is as follows.

| | |
|---|---|
| First ultraviolet crosslinkable resin (PETIA from DAICEL-CYTEC Co., Ltd.) | 9 parts |
| Second ultraviolet crosslinkable resin (HDDA from DAICEL-CYTEC Co., Ltd.) | 1 part |
| Polymerization initiator (IRGACURE 184 from Ciba Specialty Chemicals) | 1 part |
| 2-Butanone | 89 parts |

3. Coating Liquid 3

The formula of the coating liquid 3 is as follows.

| | |
|---|---|
| First ultraviolet crosslinkable resin (PETIA from DAICEL-CYTEC Co., Ltd.) | 7 parts |
| Second ultraviolet crosslinkable resin (ODA-N from DAICEL-CYTEC Co., Ltd.) | 3 parts |
| Polymerization initiator (IRGACURE 184 from Ciba Specialty Chemicals) | 1 part |
| 2-Butanone | 89 parts |

4. Coating Liquid 4

The formula of the coating liquid 4 is as follows.

| | |
|---|---|
| First ultraviolet crosslinkable resin (PETIA from DAICEL-CYTEC Co., Ltd.) | 2 parts |
| Second ultraviolet crosslinkable resin (UN-2700 from Negami Chemical Industrial Co., Ltd.) | 8 parts |
| Polymerization initiator (IRGACURE 184 from Ciba Specialty Chemicals) | 1 part |
| 2-Butanone | 89 parts |

5. Coating Liquid 5

The formula of the coating liquid 5 is as follows.

| | |
|---|---|
| Ultraviolet crosslinkable resin (DPHA from DAICEL-CYTEC Co., Ltd.) | 10 parts |
| Polymerization initiator (IRGACURE 184 from Ciba Specialty Chemicals) | 1 part |
| 2-Butanone | 89 parts |

6. Coating Liquid 6

The formula of the coating liquid 6 is as follows.

| | |
|---|---|
| Ultraviolet crosslinkable resin (DPCA-120 from Nippon Kayaku Co., Ltd.) | 10 parts |
| Polymerization initiator (IRGACURE 184 from Ciba Specialty Chemicals) | 1 part |
| 2-Butanone | 89 parts |

7. Coating Liquid 7

The formula of the coating liquid 7 is as follows.

| | |
|---|---|
| First ultraviolet crosslinkable resin (UN-904 from Negami Chemical Industrial Co., Ltd.) | 3 parts |
| Second ultraviolet crosslinkable resin (UN-2700 from Negami Chemical Industrial Co., Ltd.) | 7 parts |
| Polymerization initiator (IRGACURE 184 from Ciba Specialty Chemicals) | 1 part |
| 2-Butanone | 89 parts |

The acrylic component, the main skeleton, the number of functional groups and the functional group equivalent molecular weight of the ultraviolet crosslinkable resins are shown in Table 1 below.

TABLE 1

| Ultraviolet crosslinkable resin | Acrylic component | Main skeleton | Number of functional groups | Functional group equivalent molecular weight |
|---|---|---|---|---|
| PETIA | Penta-erythritol triacrylate | Penta-erythritol triacrylate | 3 | 99 |
| DPHA | Dipenta-erythritol hexaacrylate | Penta-erythritol triacrylate | 6 | 96 |
| DPCA-120 | ϵ-caprolactone modified dipenta-erythritol hexaacrylate | Penta-erythritol triacrylate | 6 | 350 |
| ODA-N | Octyl/decyl acrylate | — | 1 | 226 |
| HDDA | Hexanediol diacrylate | — | 2 | 104 |
| UN-2700 | Urethane acrylate | — | 2 | 1000 |
| UN-904 | Urethane acrylate | — | 9 | 500 |

Example 1

A strip of the urethane rubber 1 mentioned above having a thickness of 1.8 mm was prepared. An end portion of the strip-shaped rubber was dipped in the coating liquid 1 mentioned above for 30 seconds, and then dried naturally for 3 minutes. Next, the coating liquid 1 was applied on the tip (62*a*) of the resin-impregnated portion of the strip-shaped rubber using a spray gun, which was moved at a speed of 10 mm/s This spray coating was repeated so that a layer having a predetermined thickness (1 μm in this example) was formed on the tip (62*a*) of the strip-shaped rubber. Next, the coating liquid 1 was also applied repeatedly on a front portion of the lower surface (62*b*) of the resin-impregnated portion using the spray gun. The thus applied layers were naturally dried for 3 minutes such that the dried layers are not damaged even when being contacted with a finger (i.e., the dried layers achieve a dust-free state).

After the coated layers were dried, the strip-shaped rubber was repeatedly subjected to an ultraviolet irradiation treatment in which an ultraviolet lamp with a power of 140 W/cm irradiates the coated layers at a speed of 5 m/min, 5 times to crosslink the ultraviolet crosslinkable resin used for the impregnation treatment and the outermost layer. Thus, an elastic blade of Example 1 was prepared.

The thus prepared elastic blade was fixed to a metal holder by an adhesive to prepare a cleaning blade 62, and the cleaning blade was set to a full color multifunctional product (MFP), IMAGIO MP C4500 from Ricoh Co., Ltd., which has such an image forming section as illustrated in FIGS. 2 and 3. In this regard, the cleaning blade 62 was contacted with the surface of the photoreceptor at a linear pressure of 20 g/cm, and an angle of 79°. As illustrated in FIG. 3, the multifunctional product has the lubricant applicator 10, and therefore the surface of the photoreceptor 3 has a static friction coefficient of not greater than 0.2, which is measured by an Euler belt method described in JP-H09-166919A or US20060093955 incorporated by reference.

A polymerization toner was used for the multifunctional product.

Specifically, 100 parts by weight of toner particles which had been prepared by a polymerization method and which have an average circularity of 0.98 and an average particle diameter of 4.9 mm were mixed with external additives, i.e., 1.5 parts of a silica (H2000 from Clariant Japan K.K.) having a relatively small particle diameter, 0.5 parts of a titanium oxide (MT-150AI from Tayca Corp.) having a relatively small particle diameter, and 1.0 part of another silica (UFP-30H from Denki Kagaku Kogyo K.K.) having a relatively large particle diameter.

The evaluation of the cleaning blade was performed as follows.

1. Pencil Hardness of Outermost Layer

The pencil hardness of the outermost layer was measured by the method defined in JIS K 5600-5-4.

Specifically, a pencil is set in a slanting through-hole of a metal block of the tester with two wheels, which hole is slanted at an angle of 45±1° relative to the surface of a sample, and is then fixed to the metal block by a cramp. A level is set on the upper surface of the metal block to keep the metal block horizontal. In addition, a weight of 750±1° is applied to the tip of the pencil, which is contacted with the surface of the sample. The test is performed under environmental conditions of 23±2° C. and 50±5% RH. Before setting the pencil to the metal block, the pencil is sharpened using a sharpener so that the tip of the lead thereof has a smooth cylindrical form and the length of the front portion of the lead thereof is from 5 mm to 6 mm. In addition, the tip of the lead is contacted with an abrasive paper at an angle of 90° and is moved back and forth to be flattened.

When the pencil is inserted into slanting hole to an extent such that the tip of the pencil is contacted with the surface of the sample, the pencil is fixed to the metal block by the cramp. The metal block is moved at a length of not less than 7 mm at a speed of from 0.5 to 1 mm/sec. When a scratch with a length of not less than 3 mm is not formed on the surface of the sample, the pencil is replaced with another pencil having a high hardness and the test is repeated. If no scratch is formed on the surface of the sample by a pencil with a hardness of 6H but a scratch with a length of not less than 3 mm is formed on the surface, the pencil hardness of the sample is 6H.

In this regard, the hardness of a rubber is measured with the method defined in JIS K6253 using a durometer manufactured by Shimadzu Corporation while the hardness of an outermost layer is measured with the method defined in JIS K 5600-5-4. It is described in a published Japanese patent application JP2010-113133A that when the hardness of a rubber and an ultraviolet crosslinked resin is measured with a micro hardness tester (e.g., HM-2000 from Fischer) to determine the Martens hardness thereof, the rubber has a Martens hardness of about 0.8N/mm$^2$ and the ultraviolet crosslinked resin has a Martens hardness of not less than 300N/mm$^2$, which is much higher than that of the rubber.

Therefore, it can be easily understood that the outermost layer has much higher hardness than a rubber in this application.

2. Thickness of Outermost Layer

A portion of the cover layer apart from the edge 62*c* by 50 nm was cut by a trimming knife (from Nisshin EM Corp.) for use in preparing a sample to be observed with a scanning electron microscope. The cross-section of the cut portion was observed with a microscope VHX-100 from Keyence Corporation to determine the thickness of the outermost layer.

3. Depth of Resin-Impregnated Portion

The resin-impregnated portion of the rubber (before the crosslinking treatment) is cut with a microtome and the cross-section of the resin-impregnated portion is subjected to IR spectroscopy using an instrument such as FT/IR 6100 type A from JASCO Corporation. In this regard, the length (depth) of the resin-impregnated portion is determined by measuring the length of a portion having an IR spectrum such that a peak of 810 cm$^{-1}$ specific to an acrylic group is observed.

4. Width of Abraded Portion of Cleaning Blade

An image forming operation, in which three copies of an A4-size original image with an image area proportion of 5% are produced under environmental conditions of 21° C. and 65% RH, was repeated until 50,000 copies were produced. In this regard, the A4-size recording paper sheet was fed in a direction such that the longer side of the sheet is perpendicular to the feeding direction thereof.

Figure 6:
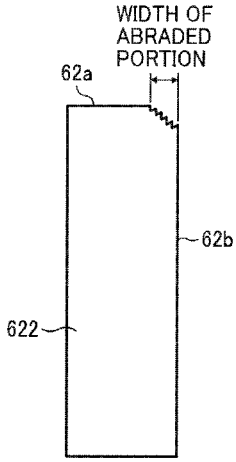
FIG. 6 is a schematic view for explaining the way to determine width of an abraded portion of an elastic blade.

After the 50,000-copy running test, the edge 62*c* of the cleaning blade was visually observed to determine the width of the abraded portion, which is illustrated in FIG. 6.

5. Cleanability of Cleaning Blade

After the 50,000-copy running test, 20 copies of an original image having three horizontal stripe images each having a width of 43 mm were produced. The stripe images were visually observed to determine whether the cleaning blade causes defective cleaning (i.e., whether the stripe images have a defectively cleaned portion such as white lines and low density stripe portions).

6. Abnormal Sounds

The running test was performed while listening to the image forming apparatus to determine whether abnormal sounds are generated by the cleaning blade.

The evaluation results are shown in Tables 2-1 and 2-2 below.

Example 2

The procedure for preparation and evaluation of the cleaning blade of Example 1 was repeated except that the urethane rubber 1 was replaced with the urethane rubber 2, and the coating liquid 1 used for the impregnation treatment and for forming the outermost layer was replaced with the coating liquid 2.

The evaluation results of the thus prepared cleaning blade of Example 2 are shown in Tables 2-1 and 2-2 below.

Example 3

The procedure for preparation and evaluation of the cleaning blade of Example 1 was repeated except that the urethane rubber 1 was replaced with the urethane rubber 3, and the coating liquid 1 used for the impregnation treatment and for forming the outermost layer was replaced with the coating liquid 3.

The evaluation results of the thus prepared cleaning blade of Example 3 are shown in Tables 2-1 and 2-2 below.

Example 4

The procedure for preparation and evaluation of the cleaning blade of Example 1 was repeated except that the urethane rubber 1 was replaced with the urethane rubber 3, and the coating liquid 1 used for the impregnation treatment and for forming the outermost layer was replaced with the coating liquid 4.

The evaluation results of the thus prepared cleaning blade of Example 4 are shown in Tables 2-1 and 2-2 below.

Example 5

The procedure for preparation and evaluation of the cleaning blade of Example 1 was repeated except that the urethane rubber 1 was replaced with the urethane rubber 4, and the coating liquid 1 used for the impregnation treatment and for forming the outermost layer was replaced with the coating liquid 5.

The evaluation results of the thus prepared cleaning blade of Example 5 are shown in Tables 2-1 and 2-2 below.

Example 6

The procedure for preparation and evaluation of the cleaning blade of Example 1 was repeated except that the urethane rubber 1 was replaced with the urethane rubber 5, and the coating liquid 1 used for the impregnation treatment and for forming the outermost layer was replaced with the coating liquid 6.

The evaluation results of the thus prepared cleaning blade of Example 6 are shown in Tables 2-1 and 2-2 below.

Example 7

The procedure for preparation and evaluation of the cleaning blade of Example 1 was repeated except that the urethane rubber 1 was replaced with the urethane rubber 2, and the coating liquid 1 used for forming the outermost layer was replaced with the coating liquid 2.

The evaluation results of the thus prepared cleaning blade of Example 7 are shown in Tables 2-1 and 2-2 below.

Example 8

The procedure for preparation and evaluation of the cleaning blade of Example 1 was repeated except that the urethane rubber 1 was replaced with the urethane rubber 2, and the coating liquid 1 used for the impregnation treatment and for forming the outermost layer was replaced with the coating liquids 2 and 3, respectively.

The evaluation results of the thus prepared cleaning blade of Example 8 are shown in Tables 2-1 and 2-2 below.

Example 9

The procedure for preparation and evaluation of the cleaning blade of Example 1 was repeated except that the urethane rubber 1 was replaced with the urethane rubber 3, and the coating liquid 1 used for forming the outermost layer was replaced with the coating liquid 5.

The evaluation results of the thus prepared cleaning blade of Example 9 are shown in Tables 2-1 and 2-2 below.

Example 10

The procedure for preparation and evaluation of the cleaning blade of Example 1 was repeated except that the urethane rubber 1 was replaced with the urethane rubber 3, and the coating liquid 1 used for the impregnation treatment was replaced with the coating liquid 2.

The evaluation results of the thus prepared cleaning blade of Example 10 are shown in Tables 2-1 and 2-2 below.

Comparative Example 1

The procedure for preparation and evaluation of the cleaning blade of Example 1 was repeated except that the urethane rubber 1 was replaced with the urethane rubber 3, the impregnation treatment was not performed, and the outermost layer was not formed.

The evaluation results of the thus prepared cleaning blade of Comparative Example 1 are shown in Tables 2-1 and 2-2 below.

Comparative Example 2

The procedure for preparation and evaluation of the cleaning blade of Example 1 was repeated except that the urethane rubber 1 was replaced with the urethane rubber 3, and the impregnation treatment was not performed.

The evaluation results of the thus prepared cleaning blade of Comparative Example 2 are shown in Tables 2-1 and 2-2 below.

Comparative Example 3

The procedure for preparation and evaluation of the cleaning blade of Example 1 was repeated except that the urethane rubber 1 was replaced with the urethane rubber 3, and the coating liquid 1 used for the impregnation treatment and for forming the outermost layer was replaced with the coating liquid 7.

The evaluation results of the thus prepared cleaning blade of Comparative Example 3 are shown in Tables 2-1 and 2-2 below.

Comparative Example 4

The procedure for preparation and evaluation of the cleaning blade of Example 1 was repeated except that the urethane rubber 1 was replaced with the urethane rubber 3, and the coating liquid 1 used for the impregnation treatment and for forming the outermost layer was replaced with the coating liquid 7.

The evaluation results of the thus prepared cleaning blade of Comparative Example 3 are shown in Tables 2-1 and 2-2 below.

TABLE 2-1

| | Base material | Impregnation treatment (No. of coating liquid) | No. of outermost layer coating liquid | Pencil hardness of outermost layer | Thickness of outermost layer (μm) | Depth of resin-impregnated portion (μm) |
|---|---|---|---|---|---|---|
| Ex. 1 | Urethane rubber 1 | Yes (1) | 1 | 9H | 1 | 20 |
| Ex. 2 | Urethane rubber 2 | Yes (2) | 2 | 9H | 1 | 20 |
| Ex. 3 | Urethane rubber 3 | Yes (3) | 3 | 8H | 1 | 20 |
| Ex. 4 | Urethane rubber 3 | Yes (4) | 4 | 7H | 1 | 20 |

TABLE 2-1-continued

| | Base material | Impregnation treatment (No. of coating liquid) | No. of outermost layer coating liquid | Pencil hardness of outermost layer | Thickness of outermost layer (μm) | Depth of resin-impregnated portion (μm) |
|---|---|---|---|---|---|---|
| Ex. 5 | Urethane rubber 4 | Yes (5) | 5 | 9H | 1 | 15 |
| Ex. 6 | Urethane rubber 5 | Yes (6) | 6 | 9H | 1 | 10 |
| Ex. 7 | Urethane rubber 2 | Yes (1) | 2 | 9H | 1 | 30 |
| Ex. 8 | Urethane rubber 2 | Yes (2) | 3 | 8H | 1 | 20 |
| Ex. 9 | Urethane rubber 3 | Yes (1) | 5 | 9H | 1 | 30 |
| Ex. 10 | Urethane rubber 3 | Yes (2) | 1 | 9H | 1 | 25 |
| Comp. Ex. 1 | Urethane rubber 3 | No | No outermost layer | — | — | — |
| Comp. Ex. 2 | Urethane rubber 3 | No | 1 | 9H | 1 | 0 |
| Comp. Ex. 3 | Urethane rubber 3 | Yes (7) | 7 | 6H | 1 | 10 |
| Comp. Ex. 4 | Urethane rubber 3 | Yes (7) | 7 | 6H | 5 | 10 |

TABLE 2-2

| | Width of abraded portion (μm) | Cleanability | Abnormal sounds | Others |
|---|---|---|---|---|
| Ex. 1 | 5 | No defective cleaning | No | |
| Ex. 2 | 5 | No defective cleaning | No | |
| Ex. 3 | 5 | No defective cleaning | No | |
| Ex. 4 | 5 | No defective cleaning | No | |
| Ex. 5 | 5 | No defective cleaning | No | |
| Ex. 6 | 5 | No defective cleaning | No | |
| Ex. 7 | 5 | No defective cleaning | No | |
| Ex. 8 | 5 | No defective cleaning | No | |
| Ex. 9 | 5 | No defective cleaning | No | |
| Ex. 10 | 5 | No defective cleaning | No | |
| Comp. Ex. 1 | 40 | Three defectively cleaned stripe portions | No | Tip of blade was abrades as illustrated in FIG. 8(b). |
| Comp. Ex. 2 | 20 | Two defectively cleaned stripe portions | No | Everted-tip problem occurred. |
| Comp. Ex. 3 | 200 | Fifteen defectively cleaned stripe portions | Abnormal sounds due to vibration of blade | Tip of blade was abrades as illustrated in FIG. 8(b). |
| Comp. Ex. 4 | 200 | Seven defectively cleaned stripe portions | Abnormal sounds due to vibration of blade | |

Figure 7A:
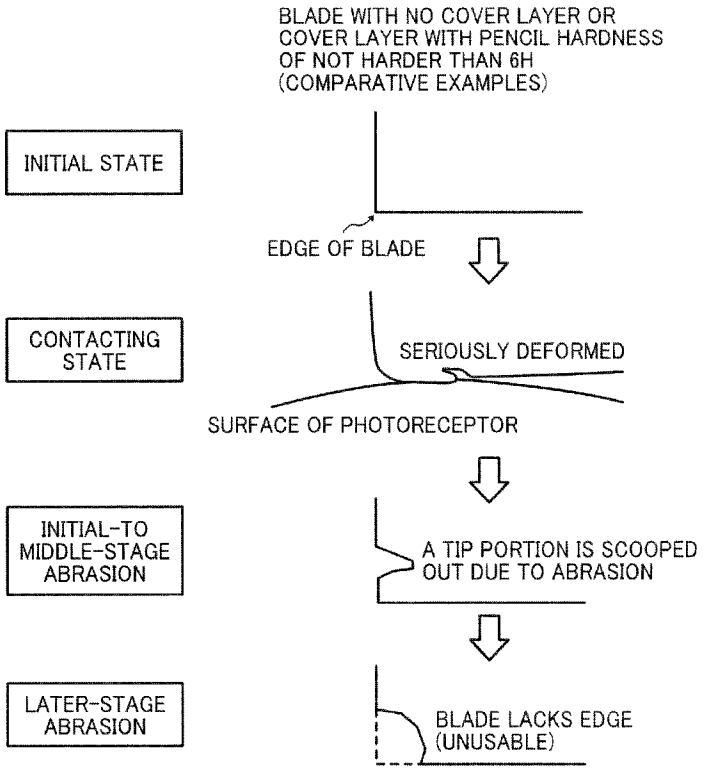
FIGS. 7A and 7B are schematic views for explaining differences between a cleaning blade of this disclosure and a comparative cleaning blade.
Figure 7B:
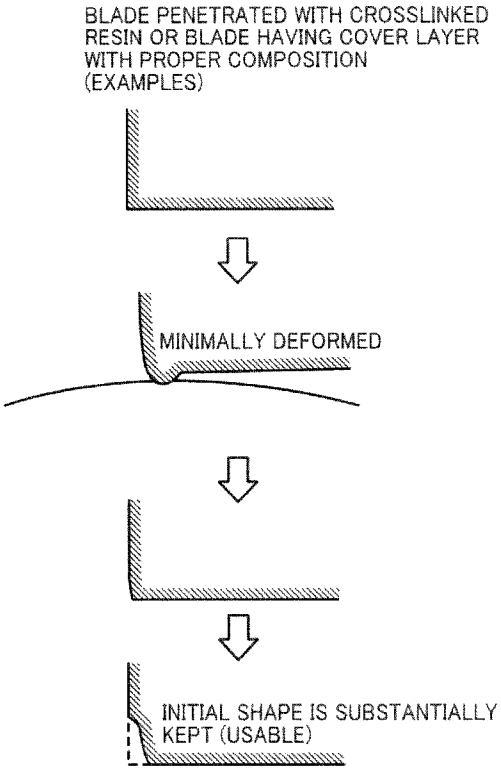

The behavior of the cleaning blades of Examples 1-6 is illustrated in FIG. 7B, and the behavior of the cleaning blades of Comparative Examples 1-4 is illustrated in FIG. 7A.

It is clear from Tables 2-1 and 2-2 that the blades of Examples 1-6 can maintain good cleanability over a long period of time without causing the abnormal sound problem.

In Examples 1-6, the hardness of the elastic blades is enhanced by subjecting the blades to an impregnation treatment, and further the edge 62*c* thereof is subjected to a modification treatment (i.e., an outermost layer is formed thereon). In addition, the surface of the photoreceptor 3 is coated with a lubricant by the lubricant applicator 10 to control the friction coefficient thereof to be not greater than 0.2, which is measured when an image forming operation is not performed. Therefore, generation of abnormal sounds can be prevented by the combination of the photoreceptor on which the lubricant is applied and the cleaning blade having the outermost layer 623 on the leading end portion thereof. Further, frictional force generated between the surface of the photoreceptor 3 and the edge 62*c* of the cleaning blade 62 can be reduced, thereby preventing occurrence of the everted-tip problem while reducing abrasion loss of the tip of the elastic blade 622. The outermost layer 623 reinforces the contact portion (i.e., the edge 62*c*) of the elastic blade and the vicinity thereof, thereby properly controlling movement of the edge 62*c*, resulting in prevention of occurrence of the abnormal sound problem and the everted-tip problem.

In contrast, the cleaning blade of Comparative Example 1 causes defective cleaning, and thereby vertical strip-shaped abnormal images are formed in the resultant images. The reason therefore is considered as follows. Specifically, since the cleaning blade is not subjected to an impregnation treatment and has no outermost layer, the tip of the blade has a high friction coefficient, and therefore movement of the edge 62*c* thereof cannot be properly controlled, thereby causing abrasion of the tip of the blade as illustrated in FIG. 8(*b*). Therefore, residual toner particles on the surface of the photoreceptor 3 pass through the abraded portion of the blade, resulting in formation of vertical stripe abnormal images.

The cleaning blade of Comparative Example 2, which is not subjected to an impregnation treatment, is greatly moved when the blade is contacted with the photoreceptor, thereby forming vertical stripe abnormal images after repeated use while causing the everted-tip problem and great abrasion loss.

The outermost layer of the cleaning blade of Comparative Example 3 has a relatively low pencil hardness. Therefore, when the cleaning blade is repeatedly used, the outermost layer is abraded and base material is exposed, thereby causing the abnormal sound problem due to vibration of the leading end portion of the blade. In addition, the outermost layer of the blade is partially damaged due to local concentration of stress, thereby forming vertical stripe abnormal images.

The outermost layer of the cleaning blade of Comparative Example 4 is relatively thick (5 μm). Therefore, when the blade is contacted with the photoreceptor, movement of the blade is excessively restricted, and thereby stress is locally concentrated. Therefore, vibration energy is not diffused, thereby causing the abnormal sound problem due to vibration of the blade, and serious abrasion of the blade.

As mentioned above, the cleaning blade according to this disclosure includes an elastic blade (622), and the edge (62*c*) of the elastic blade is contacted with a surface of a rotating photoreceptor (3) to remove residual materials (such as residual toner) from the surface of the photoreceptor. The tip and vicinity of the elastic blade (622) are subjected to an impregnation treatment using an ultraviolet crosslinkable resin to form a crosslinked resin-impregnated portion (62*d*). In addition, an outermost layer (623) having higher hardness than the elastic blade (622) is formed on a leading end portion of the lower surface of the elastic blade and a tip (62*a*) of the elastic blade. Therefore, the cleaning blade can maintain good cleanability while preventing occurrence of the everted-tip problem.

The outermost layer (623) covering the surface of the tip (62*a*) and the leading end portion of the lower surface (62*b*) of the elastic blade (622) are made of an ultraviolet crosslinked resin and preferably has a thickness of not greater than 1 μm. In this case, the edge (62*c*) can maintain proper movement and hardly causes the abnormal sound problem, the everted-tip problem and the defective cleaning problem in that residual materials (such as toner particles) pass through the gap between the edge (62*c*) and the surface of the photoreceptor (3). In addition, since an outermost layer (623) having desired hardness can be easily prepared by applying an ultraviolet crosslinkable resin, and then irradiating the coated layer with ultraviolet rays, the cleaning blade can be prepared at low costs.

When the pencil hardness of the outermost layer is preferably from 7H and 9H, the cleaning blade has good durability.

When the ultraviolet crosslinkable material used for the impregnation treatment and for forming the outermost layer has a pentaerythritol triacrylate skeleton while having a functional equivalent molecular weight of not greater than 350 and 3 to 6 functional groups, the resin-impregnated portion and the outermost layer are prevented from becoming excessively brittle.

It is preferable to use a combination of the above-mentioned ultraviolet crosslinkable material and an ultraviolet crosslinkable acrylate compound having a functional equivalent molecular weight of from 100 to 1,000 and 1 to 2 functional groups to prevent the resin-impregnated portion and the outermost layer from becoming excessively brittle.

It is preferable to use a rubber including a urethane group and having a JIS-A hardness of from 65° to 77° for the elastic blade (622). In this case, even when an object to be cleaned (e.g., the photoreceptor (3)) is eccentric or the surface thereof is waved, the elastic blade can be satisfactorily contacted with the surface of the object because the elastic blade can be easily deformed, and therefore the cleaning blade can maintain good cleanability.

The image forming apparatus of this disclosure includes at least a photoreceptor (3) serving as an image bearing member, a charging roller (4) serving as a charger to charge the photoreceptor, an optical writing unit (40) serving as an irradiator to irradiate the charged photoreceptor with light to form an electrostatic latent image thereon, a developing device (5) to develop the electrostatic latent image with a developer including a toner to form a toner image on the photoreceptor, a transfer unit (60) serving as a transferring device to transfer the toner image onto a recording material (P), a cleaner (6) to remove residual toner on the surface of the photoreceptor, and a lubricant applicator (10) to apply a lubricant on the surface of the photoreceptor. The above-mentioned cleaning blade (62) is used for the cleaner (6). In addition, the friction coefficient of the surface of the photoreceptor is controlled so as to be not greater than 0.2 by applying the lubricant thereto. In this case, occurrence of the abnormal sound problem and the everted-tip problem can be prevented, and abrasion of the blade can be reduced.

In the above-mentioned example, the cleaning blade is used for cleaning the surface of a photoreceptor, but the object to be cleaned is not limited to a photoreceptor. For example, the cleaning blade can be used as the belt cleaning blade 162*a* of the belt cleaning unit 162 for cleaning the surface of the intermediate transfer belt 14.

The image forming unit 1 is a process cartridge, which includes at least a photoreceptor 3 serving as an image bearing member, and a cleaner 6 including the above-mentioned cleaning blade to remove residual materials remaining on the surface of the photoreceptor 3, and optionally includes a lubricant applicator 10 to apply a lubricant to the surface of the photoreceptor 3. The photoreceptor 3 and the cleaner 6 (and the optional lubricant applicator 10) are integrated into a single unit so as to be detachably attachable to an image forming apparatus. The lubricant applicator 10 applies a lubricant on the surface of the photoreceptor 3 when an image forming operation is not performed, so that the surface of the photoreceptor has a friction coefficient of not greater than 0.2. In this case, the surface of the photoreceptor can be satisfactorily cleaned by the cleaning blade, resulting in formation of high quality images over a long period of time.

Additional modifications and variations of the present invention are possible in light of the above teachings. It is therefore to be understood that within the scope of the appended claims the invention may be practiced other than as specifically described herein.

What is claimed is:

1. A cleaning blade for cleaning a moving surface of an object by contacting an edge thereof with the moving surface, comprising:

a strip-shaped elastic main body, in which a leading end portion thereof including the edge includes a first ultraviolet crosslinked resin therein; and an outermost layer located on a surface of the leading end portion including the edge, wherein the outermost layer has higher hardness than the strip-shaped elastic main body.

2. The cleaning blade according to claim 1, wherein the outermost layer has a pencil hardness of from 7H to 9H.

3. The cleaning blade according to claim 1, wherein the outermost layer includes the first ultraviolet crosslinked resin or a second ultraviolet crosslinked resin.

4. The cleaning blade according to claim 3, wherein each of the first and second ultraviolet crosslinked resins is obtained by crosslinking a composition including an ultraviolet crosslinkable material having a pentaerythritol triacrylate skeleton and having a functional group equivalent molecular weight of not greater than 350 and three to six functional groups.

5. The cleaning blade according to claim 4, wherein the composition further includes an ultraviolet crosslinkable acrylate compound having a functional group equivalent molecular weight of from 100 to 1,000 and one or two functional groups.

6. The cleaning blade according to claim 1, wherein the strip-shaped elastic main body includes a rubber having a urethane group and having a JIS-A hardness of from 65° to 77°.

7. The cleaning blade according to claim 1, wherein the first ultraviolet-crosslinked resin in the leading end portion of the strip-shaped elastic main body is prepared by impregnating the leading end portion with an ultraviolet crosslinkable material and then irradiating the ultraviolet crosslinkable material with ultraviolet rays to crosslink the material.

8. The cleaning blade according to claim 1, wherein the first ultraviolet-crosslinked resin in the leading end portion of the strip-shaped elastic main body has concentration gradient in a depth direction thereof.

9. An image forming apparatus comprising:

an image bearing member to bear a visible image on a surface thereof while moving;

a transferring device to transfer the visible image on the image bearing member to a recording material; and a cleaner to clean a surface of the image bearing member with the cleaning blade according to claim 1 after the visible image is transferred to the recording material.

10. A process cartridge comprising:

at least an image bearing member to bear a visible image thereon while moving; and a cleaner to clean a surface of the image bearing member with the cleaning blade according to claim 1 after the visible image is transferred to a recording material, wherein the image bearing member and the cleaner are integrated into a single unit so as to be detachably attachable to an image forming apparatus.

11. A method for preparing a cleaning blade having an edge to be contacted with an object to be cleaned, comprising:

impregnating a leading end portion of a strip-shaped elastic main body including the edge with a liquid including a first ultraviolet crosslinkable material;

optionally drying the coated liquid;

applying an outermost layer coating liquid including the first ultraviolet crosslinkable material or a second ultraviolet crosslinkable material to a surface of the optionally dried impregnated portion including the edge;

drying the applied outermost layer coating liquid; and irradiating the impregnated portion and the dried layer of the outermost layer coating liquid with ultraviolet rays to form a crosslinked material-impregnated portion in the leading end portion and an outermost layer including a crosslinked material and having higher hardness than the strip-shaped elastic main body on the surface of the impregnated portion.

12. The method according to claim 11, wherein each of the first and second ultraviolet crosslinkable materials includes a material having a pentaerythritol triacrylate skeleton and having a functional group equivalent molecular weight of not greater than 350 and three to six functional groups.

13. The method according to claim 12, wherein each of the first and second ultraviolet crosslinkable materials further includes an ultraviolet crosslinkable acrylate compound having a functional group equivalent molecular weight of from 100 to 1,000 and one or two functional groups.

14. The method according to claim 11, wherein the impregnating step is performed such that the first ultraviolet-crosslinkable resin in the leading end portion of the strip-shaped elastic main body has concentration gradient in a depth direction of the leading end portion.

* * * * *